US006123579A

United States Patent [19]

Ping

[11] Patent Number: 6,123,579

[45] Date of Patent: Sep. 26, 2000

[54] ELECTRICAL CONNECTOR MOUNTING ARRANGEMENT

[75] Inventor: Ching Yun Ping, Ti-Chen, Taiwan

[73] Assignee: Hon Hai Precision Ind. Co., Ltd., Taipei Hsien, Taiwan

[21] Appl. No.: 09/454,700

[22] Filed: Dec. 3, 1999

[30] Foreign Application Priority Data

Nov. 2, 1999 [TW] Taiwan ..... 88218639

[51] Int. Cl.[7] ..... H01R 13/60

[52] U.S. Cl. ..... 439/557

[58] Field of Search ..... 439/557, 536, 439/544, 562, 565, 567

[56] References Cited

U.S. PATENT DOCUMENTS 5,366,388 11/1994 Freeman et al. ..... 439/557 X
5,800,208 9/1998 Ishizuka et al. ..... 439/557

*Primary Examiner*—Renee Luebke
*Attorney, Agent, or Firm*—Wei Te Chung

[57] ABSTRACT

An electrical connector mounting arrangement according to the present invention comprises an electrical connector and a panel for mounting the electrical connector thereon. The electrical connector includes an insulative housing having a pair of receiving openings, a shell mounted to the insulative housing, and a covering securing the shell to the insulative housing. The shell has a casing portion comprising a first longitudinal wall, a second longitudinal wall and a pair of transverse walls. A resilient latching tongue forwardly depends from a rearward edge of the first longitudinal wall of the shell. The panel defines a pair of mating slots spaced apart from each other for aligning with the pair of receiving openings of the insulative housing. A fastening plate depends from an edge of each mating slot of the panel and is perpendicular to the panel, a recess being defined at an inward edge of each fastening plate for receiving the latching tongue of the shell.

15 Claims, 6 Drawing Sheets

ELECTRICAL CONNECTOR MOUNTING ARRANGEMENT

BACKGROUND OF THE INVENTION

The present invention relates to an electrical connector mounting arrangement which has a shell with a fastening mechanism, more particularly to an electrical connector mounting arrangement which can be reliably mounted on a panel for conveniently and accurately engaging with another electrical connector.

Auxiliary fastening devices such as screws are often used to secure an electrical connector mounted onto a panel. However, the assembly and disassembly process is troublesome. Other means used to secure one connector to a mating connector include retention mechanisms formed inside the respective housings of the two mating connectors. Such mechanisms tend to lose effectiveness after a period of use. Therefore, an electrical connector with an improved fastening mechanism is desired. Additionally, a shell capable of providing EMI shielding should be included on the connector to assure reliable signal transmission.

BRIEF SUMMARY OF THE INVENTION

A main object of the present invention is to provide an electrical connector mounting arrangement which has a shell with a fastening configuration that can be firmly mounted on a panel.

Another object of the present invention is to provide an electrical connector mounting arrangement which can reliably engage with another electrical connector and can endure a relatively strong insertion force.

An electrical connector mounting arrangement in accordance with the present invention comprises an electrical connector and a panel for mounting the electrical connector thereon. The electrical connector includes an insulative housing, a shell mounted to the insulative housing and a covering securing the shell to the insulative housing. The shell has a casing portion enclosing a forward portion of the insulative housing, which consists of a first longitudinal wall, a second longitudinal wall and a pair of transverse walls. A latching tongue forwardly depends from a rearward edge of the first longitudinal wall. Three locking legs depend outward from a forward edge of the first longitudinal wall of the casing portion, a pair of first strips outwardly and rearwardly depends between the three locking legs. A pair of second strips outwardly depends from a forward edge of the second longitudinal wall of the casing portion. The panel defines a pair of mating slots therein. A fastening plate depends from a lower edge of each mating slot of the panel and is substantially perpendicular to the panel. A recess is defined in an inward edge of each fastening plate for receiving the latching tongue and securing the latching tongue between the pair of fastening plates. To secure the connector to the panel, the second strips of the casing portion are inserted through the mating slots and engage with an opposite face of the panel, while the connector is rotated to a position against the mating slots on a mating face of the panel with the latching tongue being depressed. The latching tongue locks with the recesses in the fastening plates, and the three locking legs abut the mating face of the panel and the first strips abut the fastening plates.

Other objects, advantages and novel features of the invention will become more apparent from the following detailed description when taken in conjunction with the accompanying drawings.

DETAILED DESCRIPTION OF THE INVENTION

Figure 1:
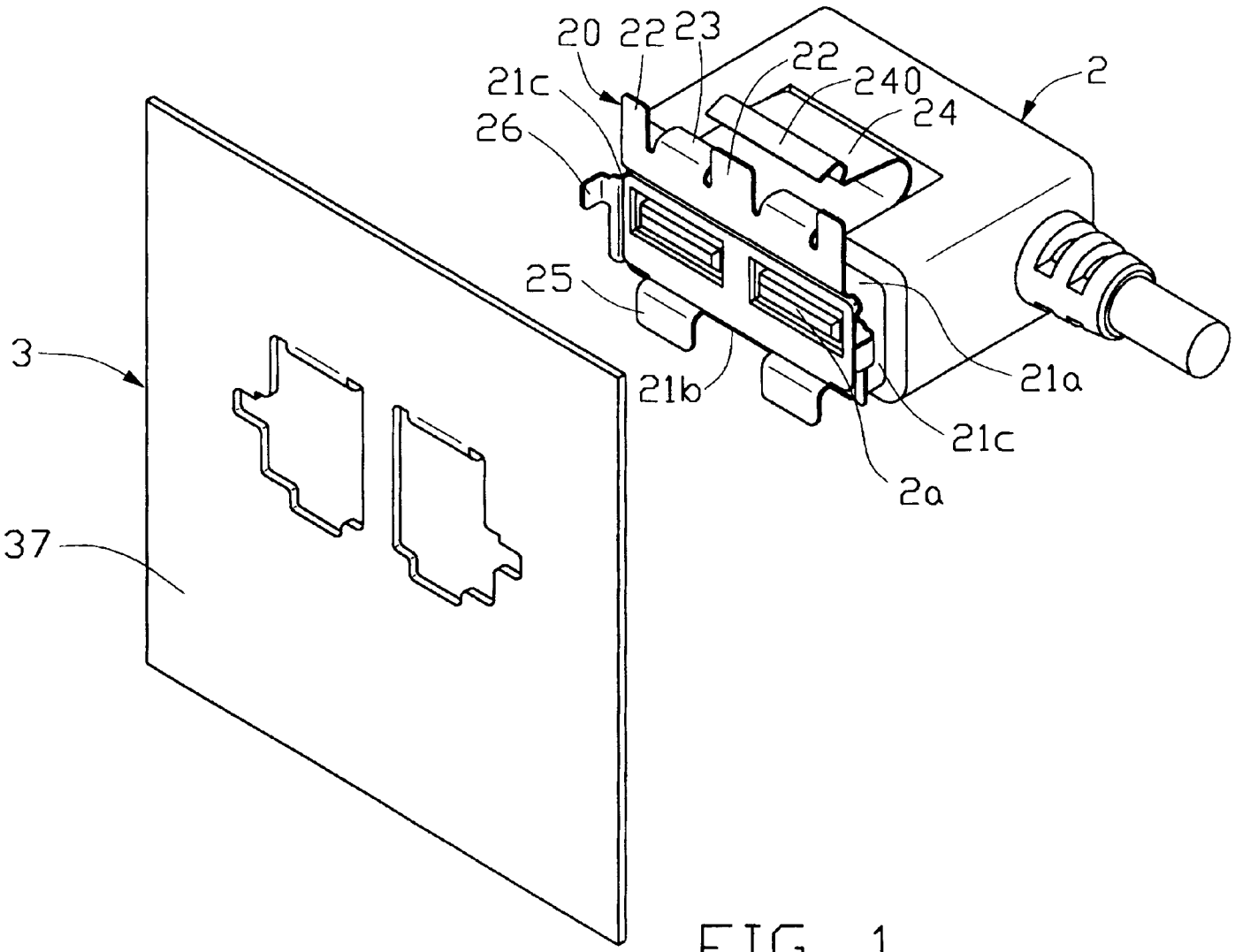
FIG. 1 is a perspective view of an electrical connector mounting arrangement of the present invention prior to connection.
Figure 5A:
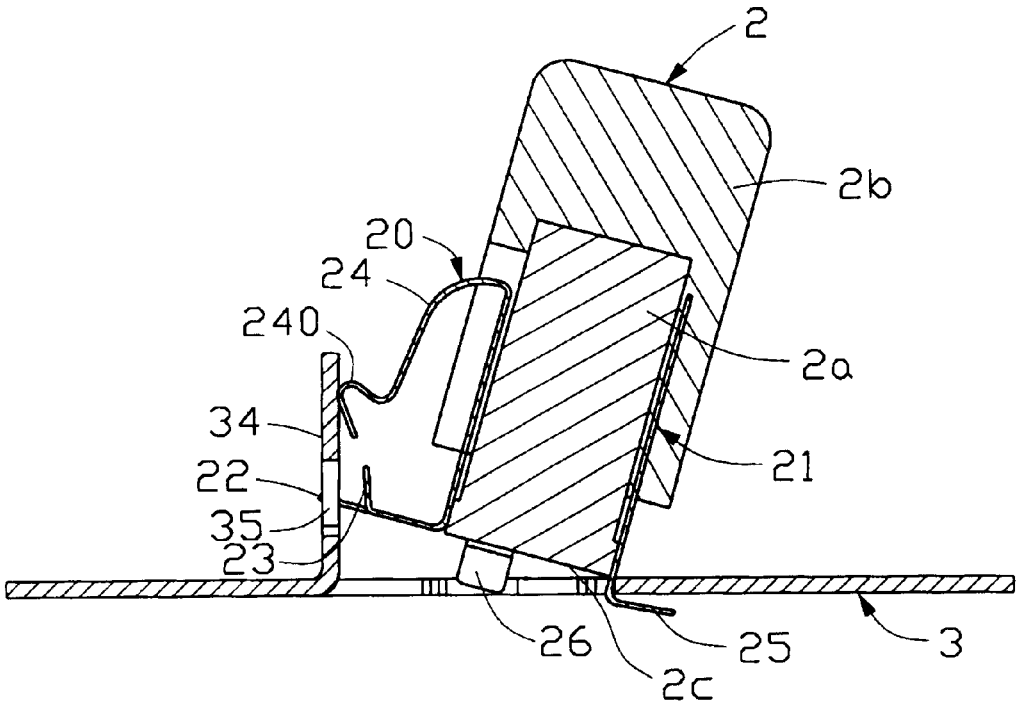
FIGS. 5A and 5B are cross-sectional views of an electrical connector being assembled to the panel in successive stages.

Referring to FIGS. 1, 5, an electrical connector mounting arrangement according to the present invention comprises an electrical connector 2 and a panel 3 for mounting the electrical connector 2 thereon. The electrical connector 2 includes a rectangular insulative housing 2*a* having a pair of receiving openings 2*c*, a shell 20 mounted to the insulative housing 2*a*, and a covering 2*b* securing the shell 20 to the insulative housing 2*a* (see FIG. 5A). The covering 2*b* shrouds a rearward periphery of the electrical connector 2, and the shell 20 shields a forward periphery of the insulative housing 2*a*. The shell 20 includes a casing portion 21 enclosing a forward portion of the insulative housing 2*a*, and the casing portion 21 comprises a first longitudinal wall 21 a, a second longitudinal wall 21 b and a pair of transverse walls 21*c*. A latching tongue 24 forwardly depends from a rearward edge of the first longitudinal wall 21*a*. The latching tongue 24 has a resilient curved end 240 at a forward distal end thereof. Three locking legs 22 respectively depend outward from a forward edge of the first longitudinal wall 21*a* and are perpendicular to the first longitudinal wall 21*a*, a middle locking leg 22 of three being wider than the other two. A pair of first strips 23 outwardly and rearwardly depends from a forward end of the first longitudinal wall 21 a between the three locking legs 22. A pair of second strips 25 outwardly depends from a forward end of the second longitudinal wall 21*b* and is substantially perpendicular to the second longitudinal wall 21*b*. A locking tab 26 extends forward from a forward edge of each transverse wall 21*c* and is substantially parallel to the transverse wall 21*c*.

Figure 2:
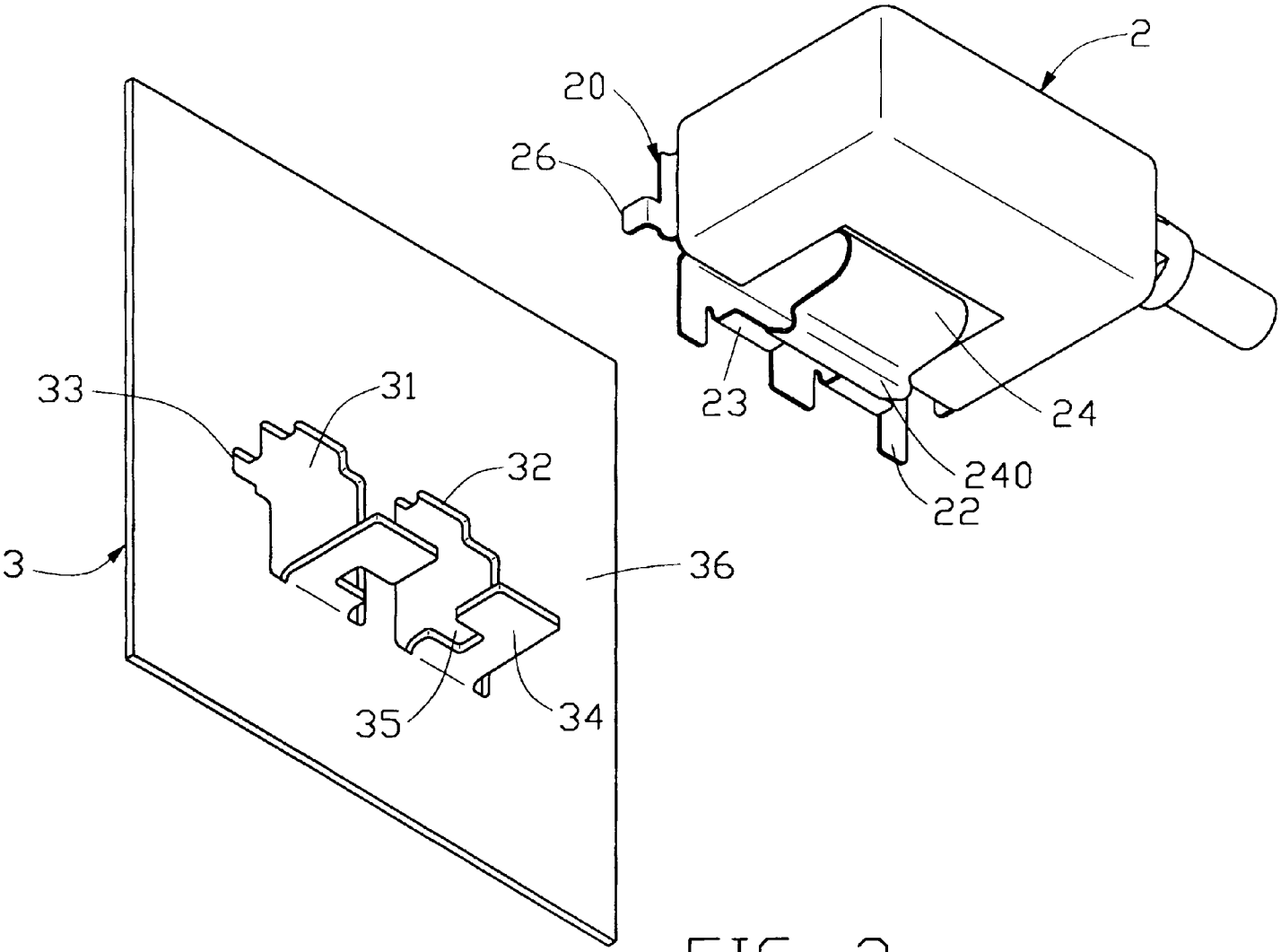
FIG. 2 is the electrical connector of FIG. 1 from another aspect.

Referring to FIG. 2, the panel 3 is substantially rectangular and defines a pair of mating slots 31 side-by-side therein for accommodating the shell 20. The mating slots 31 are spaced apart from each other and correspond to the pair of receiving openings 2*c* of the insulative housing 2*a* of the electrical connector 2. A fastening plate 34 depends from a lower edge of each mating slot 31 and is perpendicular to the panel 3. Each of the pair of fastening plates 34 is generally rectangular and is adjacent to the other. A recess 35 is defined in an inward edge of each fastening plate 34, opening toward the other fastening plate 34, for receiving the curved end 240 of the latching tongue 24 of the shell 20. A notch 32 is defined at an edge of each mating slot 31 and is located opposite to the fastening plate 34 for receiving the second strip 25 of the shell 20 of the electrical connector 2. A pair of opposing cutouts 33 is defined in outside edges of the pair of mating slots 31 for respectively receiving the locking tabs 26 of the shell 20 of the electrical connector 2.

Figure 5B:
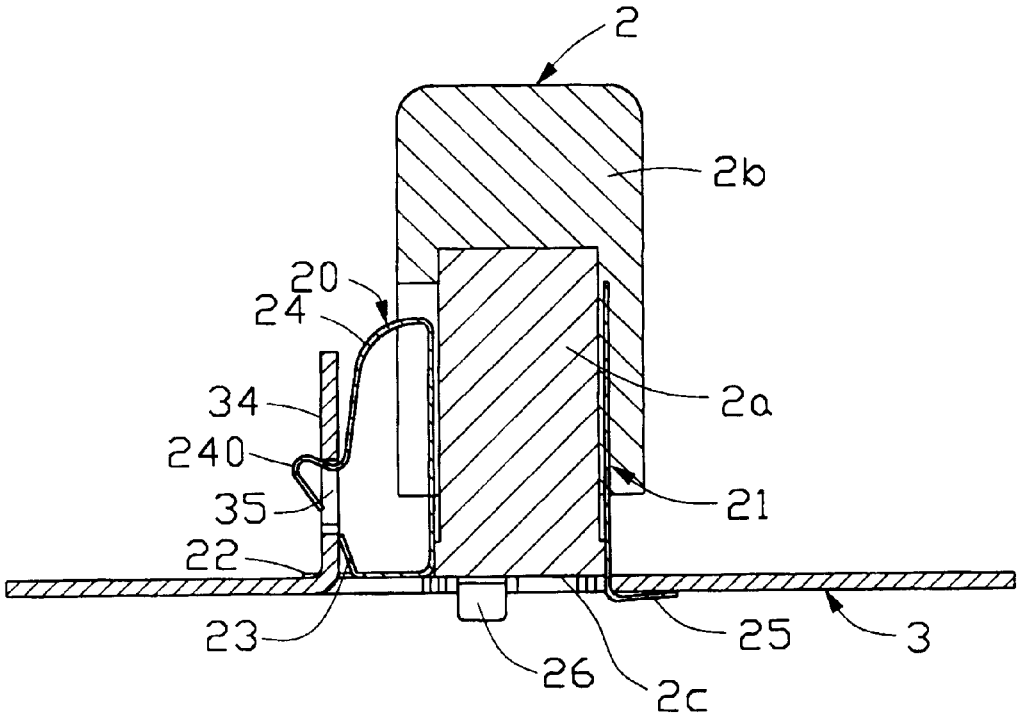

During assembly, referring to FIGS. 5A and 5B, the second strips 25 of the shell 20 of the electrical connector 2 are first inserted through the mating slots 31 of the panel 3 and are respectively received in the notches 32 of the panel 3. The curved end 240 of the latching tongue 24 of the shell 20 contacts the fastening plates 34 of the panel 3. While pressing a top position of the latching tongue 24, the curved end 240 of the latching tongue 24 is inserted through the opposite recesses 35 of the fastening plates 34, and locks into place due to the resiliency of the latching tongue 24.

Figure 3:
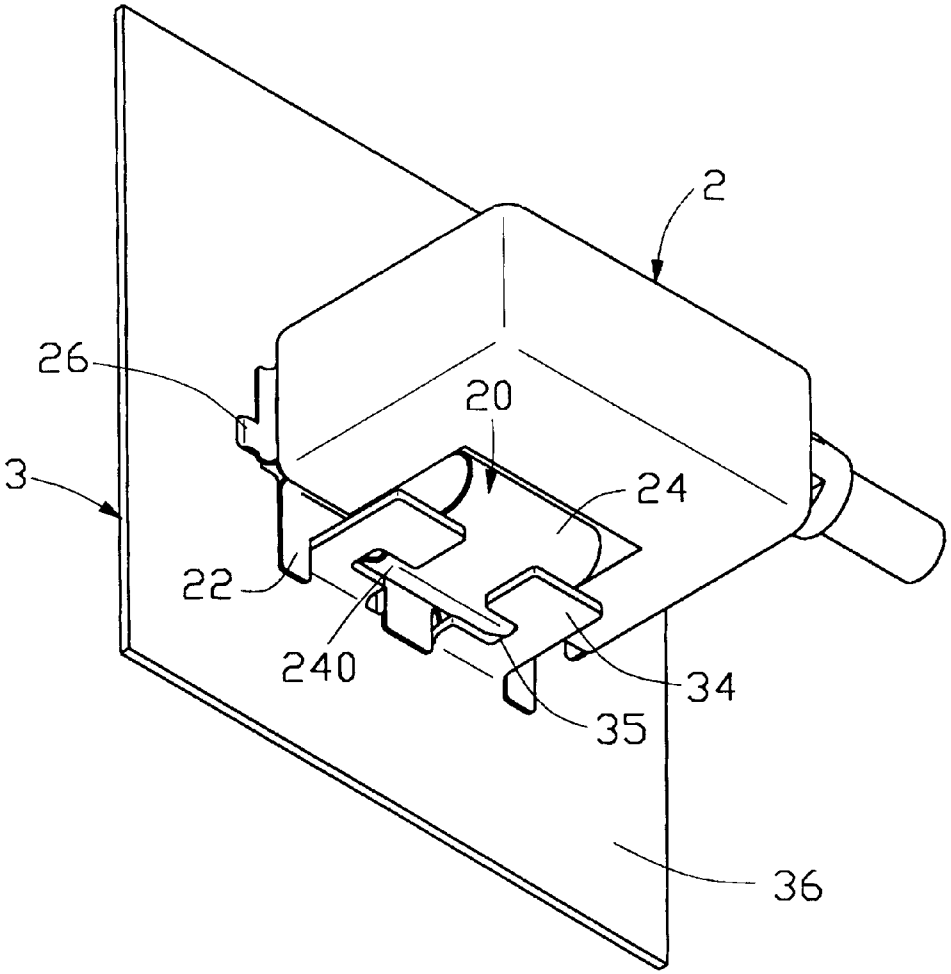
FIG. 3 is a perspective view of the electrical connector mounting arrangement after connection.
Figure 4:
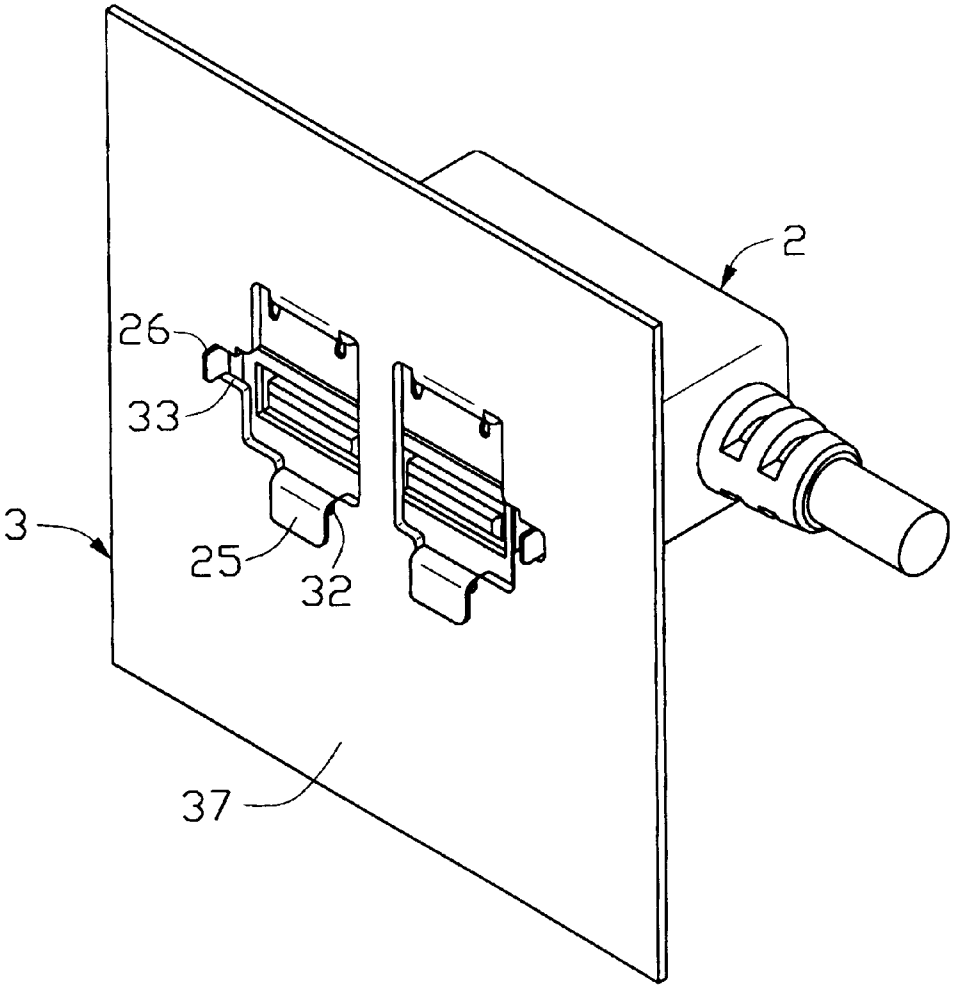
FIG. 4 is the electrical connector of FIG. 3 from another aspect.

When assembled, referring to FIGS. 3 and 4, the curved end 240 is secured in the recesses 35 of the fastening plates 34. The pair of fastening plates 34 is retained between the three locking legs 22, and the locking legs 22 abut against a mating face 36 of the panel 3. The pair of first strips 23 abut against the fastening plates 34 of the panel 3. The pair of second strips 25 abut against an opposite face 37 of the panel 3 and the locking tabs 26 are respectively received in the cutouts 33 of the panel 3.

Figure 6A:
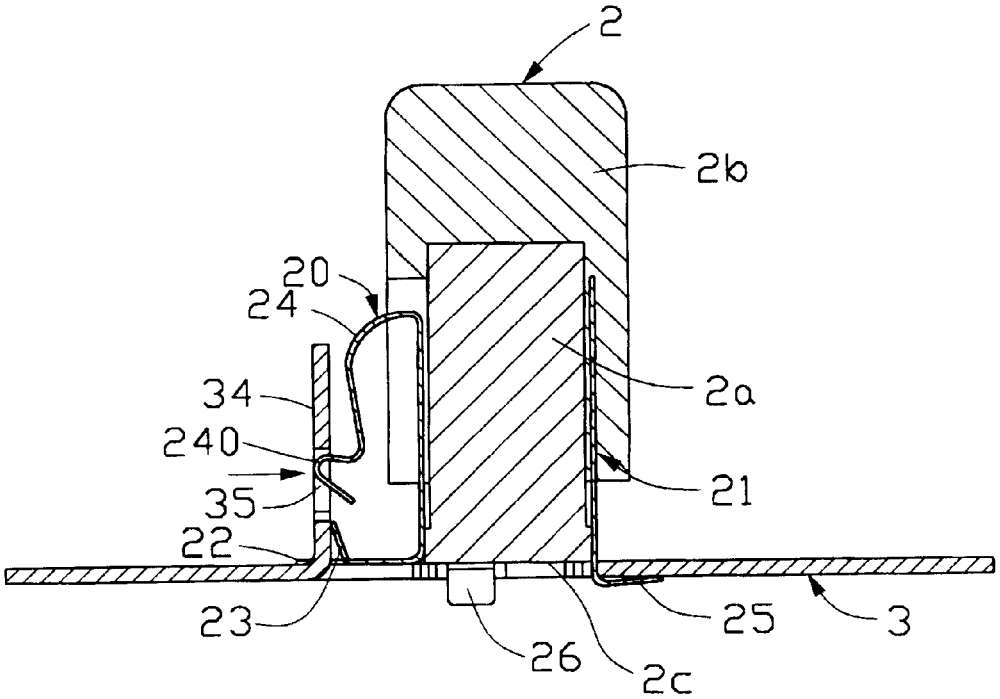
FIGS. 6A and 6B are cross-sectional views of the electrical connector being disassembled from the panel in successive stages.
Figure 6B:
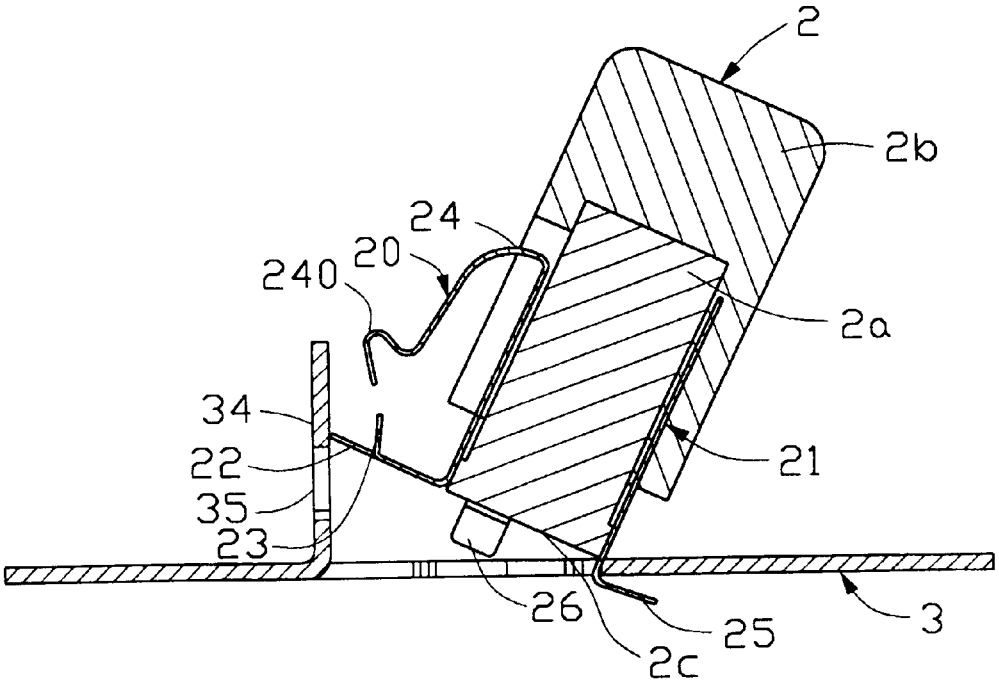

Referring to FIGS. 6A and 6B, during disassembly, the curved end 240 of the latching tongue 24 of the shell 20 is first disengaged from the recesses 35 of the fastening plates 34 of the panel 3 by pressing against the curved end 240 while rotating the connector 2 away from the panel 3. The locking tabs 26 and the second strips 25 of the shell 20 are respectively removed from the cutouts 33 and the notches 32 of the panel 3, and the electrical connector 2 is extracted from the panel 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector mounting arrangement comprising:

a panel defining a pair of mating slots spaced apart from each other, a fastening plate depending from an inward edge of each mating slot, a recess being defined at an edge of the fastening plate; and an electrical connector being mounted on the panel and including an insulative housing having a pair of receiving openings aligned with the pair of mating slots of the panel, a shell mounted to the insulative housing, and a covering securing the shell to the insulative housing, the shell having a casing portion comprising a first longitudinal wall, a second longitudinal wall and a pair of transverse walls, a resilient latching tongue forwardly depending from a rearward end of the first longitudinal wall for being retained between the pair of fastening plates, a plurality of locking legs depending outwardly from a forward edge of the first longitudinal wall for pressing against a mating face of the panel, a plurality of first strips being formed between the locking legs for abutting against the fastening plates of the panel, and a plurality of second strips depending from a forward end of the second longitudinal wall for pressing against an opposite face of the panel.

2. The electrical connector mounting arrangement as claimed in claim 1, wherein the latching tongue has a resilient curved end at a forward distal end thereof for reliably securing the latching tongue in the fastening plate.

3. The electrical connector mounting arrangement as claimed in claim 1, wherein there are two first strips and three locking legs, the two first strips outwardly and rearwardly depending from a forward end of the first longitudinal wall and interposed between the three locking legs.

4. The electrical connector mounting arrangement as claimed in claim 1, wherein there are two second strips substantially perpendicular to the second longitudinal wall.

5. The electrical connector mounting arrangement as claimed in claim 4, wherein a notch is defined at an edge of each mating slot and is located opposite to the fastening plate for receiving a corresponding second strip of the shell.

6. The electrical connector mounting arrangement as claimed in claim 1, wherein a locking tab extends forward from a forward edge of each transverse wall and is substantially parallel to the transverse wall.

7. The electrical connector mounting arrangement as claimed in claim 6, wherein a cutout is defined at an outside side edge of each mating slot, and the pair of cutouts is located opposite to each other for respectively receiving the locking tab of the shell.

8. In a panel-mounted electrical connector comprising an insulative housing having a pair of receiving openings, a shell mounted to the insulative housing, and a covering securing the shell to the insulative housing, the improvement wherein:

the shell includes a casing portion comprising a first longitudinal wall, a second longitudinal wall and a pair of transverse walls, a resilient latching tongue forwardly depending from a rearward end of the first longitudinal wall and adapted to be retained between a pair of fastening plates of a panel, a plurality of locking legs depending outwardly from a forward edge of the first longitudinal wall and adapted for pressing against a mating face of the panel, a plurality of first strips being formed between the locking legs and adapted for abutting against the fastening plates of the panel, and a plurality of second strips depending from a forward end of the second longitudinal wall and adapted for pressing against an opposite face of the panel.

9. The electrical connector as claimed in claim 8, wherein the latching tongue has a resilient curved end at a forward distal end thereof for reliably securing the latching tongue between the fastening plates.

10. The electrical connector as claimed in claim 8, wherein there are two first strips and three locking legs, the two first strips outwardly and rearwardly depending from a forward end of the first longitudinal wall and interposed between the three locking legs.

11. The electrical connector as claimed in claim 8, wherein there are two second strips substantially perpendicular to the second longitudinal wall, the two second strips being adapted to be received in a pair of notches of the panel.

12. The electrical connector as claimed in claim 8, further comprising a locking tab extending forward from a forward edge of each transverse wall, the locking tab being substantially parallel to the transverse wall and adapted to be received in a cutout of the panel.

13. An electrical connector for mounting to a panel, comprising:

an insulative housing defining at least a receiving opening therein;

a shell mounted to the housing, said shell defining a casing portion with first and second walls opposite to each other, a locking leg generally horizontally extending from a front edge of the first wall and a strip generally horizontally extending from a front edge of the second wall, said locking leg and said strip being offset from each other in a front-to-back direction of the housing, the locking leg being closer to the housing than the strip, so that when assembled, the locking leg abuts against an inner surface of the panel while the strip abuts against an outer surface of the panel, and a latching tongue formed on said first wall for latachable engagement with the panel.

14. An electrical connector assembly, comprising:

a panel defining a mating slot therein, a fastening plate extending rearwardly from a periphery edge of the mating slot with a latching recess therein;

an insulative housing defining at least a receiving opening therein;

a shell mounted to the housing, said shell defining a casing portion with first and second walls opposite to each other, a locking leg generally horizontally extending from a front edge of the first wall and a strip generally horizontally extending from a front edge of the second wall, said locking leg and said strip being offset from each other in a front-to-back direction of the housing, the locking leg abutting against an inner surface of the panel while the strip abuts an outer surface of the panel, and a latching tongue formed on said first wall being in latachable engagement within the latching recess of the fastening plate.

15. The assembly as claimed in claim 14, wherein another strip obliquely extends from the front edge of the first wall and abuts against an inner surface of the fastening plate.

* * * * *